US008786195B2

(12) United States Patent
Castiglia et al.

(10) Patent No.: US 8,786,195 B2
(45) Date of Patent: Jul. 22, 2014

(54) AUTOMATIC METHOD TO DETECT SHORT AND OPEN CONDITIONS ON THE OUTPUTS OF A LED DRIVER DEVICE

(75) Inventors: Sergio Castiglia, Agrate Brianza (IT); Roberto La Rosa, Agrate Brianza (IT)

(73) Assignee: STMicroelectronics S.r.l., Agrate Brianza (MB) (IT)

( * ) Notice: Subject to any disclaimer, the term of this patent is extended or adjusted under 35 U.S.C. 154(b) by 502 days.

(21) Appl. No.: 13/047,299

(22) Filed: Mar. 14, 2011

(65) Prior Publication Data

US 2011/0234105 A1 Sep. 29, 2011

(30) Foreign Application Priority Data

Mar. 23, 2010 (IT) ..... VI2010A0081

(51) Int. Cl.
*H01J 1/60* (2006.01)

(52) U.S. Cl.
USPC ..... 315/129; 315/130; 315/133

(58) Field of Classification Search
USPC ..... 324/705, 755, 765; 315/129–133
See application file for complete search history.

(56) References Cited

U.S. PATENT DOCUMENTS 4,563,641 A * 1/1986 Vitek et al. ..... 324/762.01
4,691,143 A * 9/1987 Lange ..... 315/133
4,924,177 A * 5/1990 Mulz ..... 324/133
6,426,593 B1 * 7/2002 Nieberger et al. ..... 315/131
6,949,941 B2 * 9/2005 Chen ..... 324/762.02
6,967,445 B1 * 11/2005 Jewell et al. ..... 315/129
2007/0013321 A1 1/2007 Ito et al.
2008/0265262 A1 10/2008 Mollet
2009/0167329 A1 * 7/2009 Lee et al. ..... 324/705

FOREIGN PATENT DOCUMENTS

EP 2 088 834 A1 8/2009

OTHER PUBLICATIONS

Search Report dated Nov. 12, 2010 for corresponding Italian Application No. VI20100081.

STMicroelectronic Product Sheet STP16DPP05, "Low voltage 16-bit constant current LED sink driver with output error detection", Oct. 2009, Doc ID 16518 Rev 1, pp. 1-32.

* cited by examiner

*Primary Examiner* — Tung X Le
(74) *Attorney, Agent, or Firm* — Wolf, Greenfield & Sacks, P.C.

(57) ABSTRACT

Driving a light-emitting element by a driver capable of testing at least an open or short condition of the light-emitting element. In particular, a driving signal is generated to drive the light-emitting element. It is evaluated based on the value of the driving signal whether a predetermined condition is reached. If so, a latch signal is output indicating that the testing has finished.

35 Claims, 5 Drawing Sheets

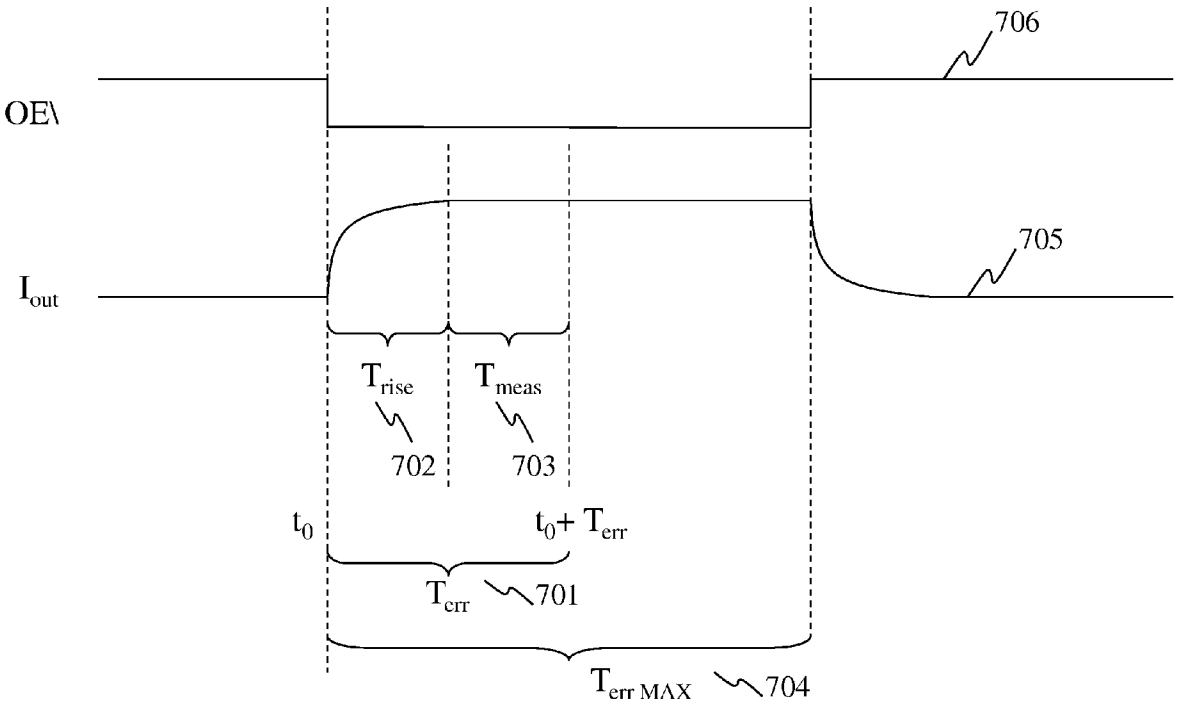
Fig. 4 STATE OF THE ART

Fig. 5 STATE OF THE ART
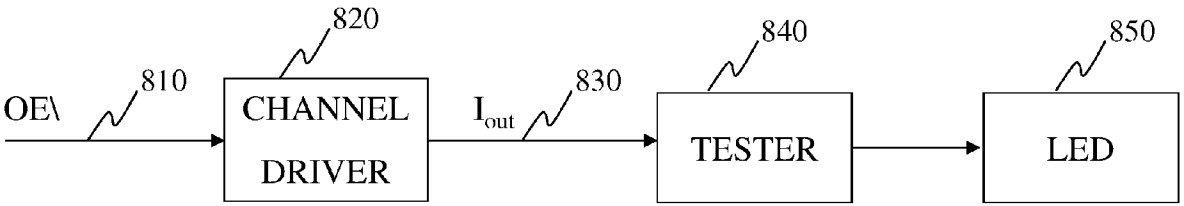

AUTOMATIC METHOD TO DETECT SHORT AND OPEN CONDITIONS ON THE OUTPUTS OF A LED DRIVER DEVICE

CROSS REFERENCE TO RELATED APPLICATIONS

This application claims the priority benefit of Italian patent application number V12010A000081, filed on Mar. 23, 2010, entitled "An Automatic Method For Detecting Short and Open Conditions On The Output Of An LED Driver Device," which is hereby incorporated by reference to the maximum extent allowable by law.

BACKGROUND OF THE INVENTION

1. Field of the Invention

The present invention relates to a driver for driving a light emitting element, the driver being capable of performing testing of the light emitting element. In particular, the present invention relates to detecting whether any channel of the driver is in an open or short condition.

2. Discussion of the Related Art

Recently, LEDs have become a popular source of light in a broad variety of applications. For instance, power LEDs have been employed as general lighting as well as for road work signs, which may be battery operated or solar powered, and also for traffic displays. LEDs may be further found in electronic goods as well as in gaming machines. In addition, LEDs represent a very efficient means for display backlighting. Full color or monochrome LED matrixes are further used for high resolution giant video displays.

In order to drive LEDs, LED drivers are used, which typically provide a plurality of output channels for driving a plurality of LEDs. An LED driver for a particular number of channels may be implemented, for instance, as an integrated circuit embedded on a chip. A plurality of such drivers may be employed in a cascade in order to enable the driving of a higher number of LEDs.

An advantageous feature of an LED driver lies in its capability of detecting short and/or open output errors. Typically, various conditions are tested on the output line such as open line, short to ground (GND) or short to Vo. Recently, LED drivers with such detection functionality have been developed and introduced on the market. For instance, STMicroelectronic product sheet STP16DPP05 (available at www.st.com) relates to a low voltage 16-bit constant current LED sink driver with output error detection. The driver of this document does not require increasing the pin count for the purpose of output error detection. Rather the existing pins are assigned a secondary function. A dedicated logic sequence on predefined pins allows the device to enter or exit from the detection mode. For instance, pins such as an output enable pin (OE) and the latch enable pin (LE) may be input a logic sequence of a predetermined duration of clock (CLK) cycles in order to switch the controller from the "normal mode" to the "error detection" mode.

In the error detection mode, an internal measurement of voltage and/or current from all the channels is performed. Thus, in order to detect a faulty condition, all channels should be ON. In a conventional LED driver, the channels are set to the ON state by setting all the outputs to logical "one", which may be performed, for instance, by means of a serial input pin (SDI). The LED driver drives the LEDs after the output enable (OE\) signal is set to an active low level, in order to analyze whether an open or short condition has occurred. During the time in which the output enable signal is low, it is possible to perform the measurement of voltage and/or current in order to detect an error as described, in particular, in Section 7 of the STP16DPP05product sheet.

Typically, the status of the LEDs is detected during a predefined error detection time. After this time period has elapsed, the circuit controlling the LED driver, for instance a microcontroller, resets the output enable signal (OE/DM2) to a high state. Then the output data detection result is sent to a serial output line (SDO). Typically, error detection mode and normal mode both use the same data format. As soon as all the detection data bits are available on the serial output line, the device may return to the normal mode of operation.

Re-entering the normal mode may be performed in a similar way to entering the detection mode, namely by inputting one or a plurality predefined pins such as OE/DL2 and LE/DM1 a predefined logical sequence within a predefined number of clock pulses.

FIG. 5 is a block diagram which illustrates a simplified functional structure of a driver for at least one LED according to the state of the art. An LED 850 is driven by a channel driver 820 by means of its output signal $I_{out}$ 830. The channel driver 820 is configured to drive the LED 850 according to an OE\ signal 810. The channel driver and the testing means may also be controlled via other input signals than the OE\ signal, as described above. Moreover, the $I_{out}$ signal 830 is tested by a tester 840 in order to determine whether the LED 850 is in a short circuit, or in an open circuit condition. For instance, by measuring the $I_{out}$ signal corresponding to 0, or lower than a predetermined value, it may be concluded that the LED 850, or the connection to the LED 850 is in an open circuit condition. Alternatively, for instance, by measuring a current higher than a predetermined threshold it is possible to conclude that the LED 850, or the connection to the LED 850 is in a short circuit condition. However, in order to perform such a testing process, the $I_{out}$ signal is preferably in a steady state. The block diagram in FIG. 5 represents the functional structure of the driver. The channel driver 820 and the tester 840 may in fact be integrated in a single chip as discussed above. In particular, the switching between the normal mode and the testing mode of the driver may be performed by a predefined logic sequence input to one or a plurality of pins of such a driver.

The duration of the error detection period necessary for performing the measurement, corresponding to the low state of the OE\ signal typically depends on parametric conditions such as voltage, temperature and process spread.

FIG. 4 illustrates a typical timing for performing the measurements. Upon switching the Output Enable (OE\) signal 706 at a time instant $t_0$ to an active low state, the output current $I_{out}$ 705 of each channel of the driver rises until it reaches a steady state value. This rise is not instantaneous but rather requires a time period $T_{rise}$ 702. The measurement of current in order to detect an open or short condition is only reliable after reaching the steady state. The time period $T_{rise}$ 702 depends on many factors such as the working voltage, temperature and process spread.

Moreover the internal circuitry of the driver performing the measurements requires a time period $T_{meas}$ 703 for performing the measurement. In order to perform the error detection reliably, the OE\ signal should thus be kept low for at least a time period $T_{err}$ 701 given by $$T_{err}=T_{rise}+T_{meas}.$$

If the OE\ signal 706 remains in the low state for a time period shorter than $T_{err}$ 701, the result of the detection may be incorrect. Thus, in order to reliably detect an open or a short condition, the ON time of the OE\ signal, corresponding to a low active state, has to be greater than $T_{err}$ 701.

In order to determine the ON time of the OE\ signal required for correctly performing the measurement, it is thus necessary to take into account the time period of signal rising $T_{rise}$ 702 and the time period necessary for performing the measurement $T_{meas}$ 703. However, both these time periods are significantly dependent on parametric conditions. Therefore, vendors of LED drivers with capability of detecting a short and/or open error condition usually provide a worst case condition in the specification of the driver, which is the time period $T_{err_MAX}$ 704 necessary for error detection in the worst case. The user then has to wait until the time period corresponding to $T_{err_MAX}$ 704 has elapsed in order to consider the test process completed and in order to read out the detection results.

Consequently, the time for the error detection is usually oversized, resulting in the LEDs being turned on for a longer time than effectively needed. However, for the majority of industrial applications, it is desirable to keep the error detection time as low as possible, in particular in cases such as LEDs with deep dimming.

SUMMARY OF THE INVENTION

Given these problems with the existing technology, it would be advantageous to provide a system capable of shortening the error detection time, and, in particular, the time necessary for turning on the light emitting element tested.

It is the particular approach of at least one embodiment of the present invention to determine, based on the driving signal, and to indicate when the testing of a light emitting element finished. This enables shortening the testing procedure and/or shortening the time during which the light emitting element(s) is/are switched on.

In accordance with one embodiment of the present invention, a driving apparatus for driving a light emitting element is provided. The driving apparatus comprises a driving means for outputting a driving signal for driving at least one light emitting element, testing means for testing the at least one light emitting element by measuring the driving signal, and evaluating means for determining whether the value of the measured driving signal reaches a predetermined condition and for outputting a latch signal indicating that testing is completed when the predetermined condition has been reached.

In accordance with another embodiment of the present invention, a driving method for driving a light emitting element is provided. The method comprises driving the light emitting element by outputting a driving signal, testing the light emitting element by measuring the driving signal, evaluating whether the value of the measured driving signal reaches a predetermined condition, and outputting a latch signal indicating that testing is completed when the predetermined condition has been reached.

BRIEF DESCRIPTION OF THE DRAWINGS

The accompanying drawings are incorporated into and form a part of a specification to illustrate several embodiments of the present invention. These drawings together with the description serve to explain the principles of the invention. The drawings are only for the purpose of illustrating preferred and alternative examples of how embodiments of the invention can be made and used, and are not to be construed as limiting the invention to only the illustrated and described embodiments. Further features and advantages will become apparent from the following and more particular description of the various embodiments of the invention, as illustrated in the accompanying drawings, in which like reference numbers refer to like elements and wherein:

FIG. 4 is a schematic drawing illustrating the timing of signals during the error detection mode in accordance with the state of the art; and FIG. 5 is a block diagram illustrating employment of an LED driver in accordance with the state of the art.

DETAILED DESCRIPTION

In the following description, for explanatory purposes, specific details are set forth in order to provide a thorough understanding thereof. It may be evident, however, that the present invention can be practiced without these specific details. Furthermore, well known structures and devices are only described in a more general form in order to facilitate the description thereof.

In the following description the expression "error detecting process" and "testing process" are used to indicate the process of testing whether an error is present on the channel of driver for driving a light emitting element.

The problem underlying embodiments of the present invention is based on the observation that the time period necessary for testing of light emitting elements essentially varies with parametric variations such as temperature, bias voltage, process spread, etc. Adjusting the measurement time based on a worst case scenario reduces the risk of incorrect error detection. However, on the other hand, the measurement time is unnecessarily long for other scenarios, which also requires keeping the light emitting element(s) on unnecessarily.

According to embodiments of the present invention, the driving apparatus automatically determines the minimum time during which the light emitting element needs to be turned on and/or tested in order to enable correct error detection. In order to facilitate this, a latch signal is generated and output, which indicates that the testing process is completed. The generation of the latch signal is triggered according to a result of evaluation of a predetermined condition based on the value of the driving signal.

The latch signal enables to determine more precisely the time instance at which reliable test results are available. This, on the other hand, provides the advantage of independency of the testing procedure results from the parametric variations. Instead of considering the worst case time period $T_{err_Max}$ 704, embodiments of the present invention provide a basis for approaching the minimum time necessary for performing the testing, namely, the time period $T_{err}$ 701. This provides advantages, in particular, for testing the light-elements such as LEDs, which are driven by signal pulses. The signal pulses become shorter in order to cause dimming of the light emitting element. With the present invention, testing time is reduced, enabling thus testing of the light-emitting elements driven by such shorter pulses.

Figure 1:
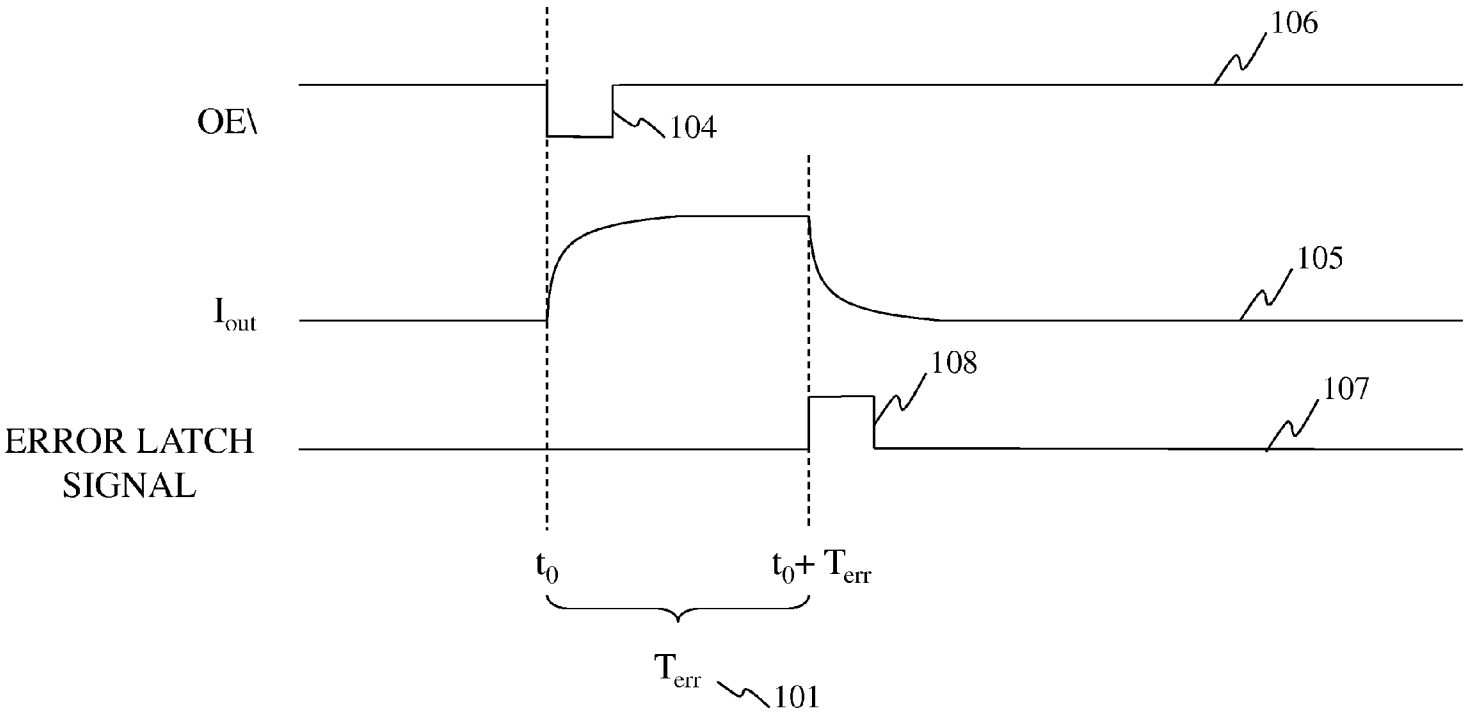
FIG. 1 is a schematic drawing illustrating the timing of signals in the error detection mode in accordance with an embodiment of the present invention.

FIG. 1 illustrates an example timing chart according to an embodiment of the present invention. The timing chart illustrated in FIG. 1 relates to the driving and testing of a single light emitting element 350. However, the present invention is not limited to this, and can be implemented to drive and test any number of light emitting components. In particular, a single driver of this embodiment the present invention may have a predetermined number of channels such as 8, 16, or any other number, each channel enabling the driving of a light emitting element. For the purpose of testing, preferably, all channels of the driver are turned on and error detection is performed. The error detection is advantageously performed in parallel for all connected light-emitting devices. However, the error detection may also be performed selectively by turning on and testing only a subset of the driver's channels.

In order to initiate the driving of a channel and thus to start the measurement procedure, a predefined signal may be input to the driver in the test mode. In particular, similarly to the testing procedure described above within the background of the invention, an output enable signal OE106 may be input in order to start the driving of the light emitting element 350. For instance, the OE\ signal may be switched to a low level, at a time instant $t_0$ in order to start the error detection process. Accordingly, at the time instant $t_0$, the light emitting element 350 (and possibly all other outputs of the driver) is turned ON and is maintained ON during the time necessary for performing a correct error detection even if the OE\ signal switches back to high. This causes the current signal $I_{out}$ 105 driving the light emitting element 350 to rise. After the time $T_{err}$ 101 necessary for performing the error detection, a signal error latch 107 is output to indicate that the error detection process has been completed. For instance, the error latch signal 107 may be switched to a high level and switched low again as exemplified in FIG. 1.

The same switching to a high level of the signal error latch 107 after a time period $T_{err}$ 101 may be used in order to drive the light emitting element 350 to an OFF state as illustrated in this embodiment of the present invention. The time period $T_{err}$ 101 depends on the current parametric conditions. This has the advantage of reducing the time during which the light emitting component is turned ON for the purposes of testing. Accordingly, keeping the light emitting element 350 in an ON state during additional unnecessary time is avoided. This results in reduced power consumption and reduced usage of the light emitting element 350.

As can be seen in FIG. 1, the signal OE\ 106 may switch back to an inactive high level during the time requested to perform the test process of the light emitting element 350. However, even in this case, the light emitting element 350 may remain turned ON until the test process has been completed since the completion of the testing is now signalled by the latch signal.

Accordingly, when a driver with such a timing characteristics is used in a system for driving a light emitting element or a plurality thereof, a system controller, for instance a microcontroller or a microprocessor, does not need to know in advance how long the error detection process will last so as to keep the signal OE\ 106 to an active low level throughout the whole test process. This simplifies the design of the system controller. Furthermore, by using the error latch signal 107 in order to indicate that the test process has been completed after a time period $T_{err}$ 101, the system controller can be alerted that the test process has been completed and/or the error detection result is available.

Moreover, at a time instant 108 after the time $T_{err}$ 101, the error latch signal 107 may return to an inactive low value. This may be performed automatically after the switching of the light emitting element 350 to an OFF state.

The above example assumed starting of the measurement procedure when a signal is input (OE\ signal 106), set to low. It further assumed indicating the end of the measurement procedure by setting an output latch signal (error latch 107) high. However, as obvious to those skilled in the art, for instance, an input signal set to high may be defined instead for initiating the measurement procedure and an output signal set to low may be defined for indicating the end of the measurement procedure. In general, any input/output signal with a predefined value may be employed to signal beginning and/or termination of the measurement procedure and availability of the error detection results.

The timing characteristics described above can provide several advantages in cases where a light emitting element 350 needs to be turned ON only for a duration necessary for performing a test process.

However, there may be situations in which the light emitting element 350 is requested to remain turned ON even after the test process has been completed. Accordingly, another embodiment of the present invention provides timing characteristics as illustrated in FIG. 2.

Figure 2:
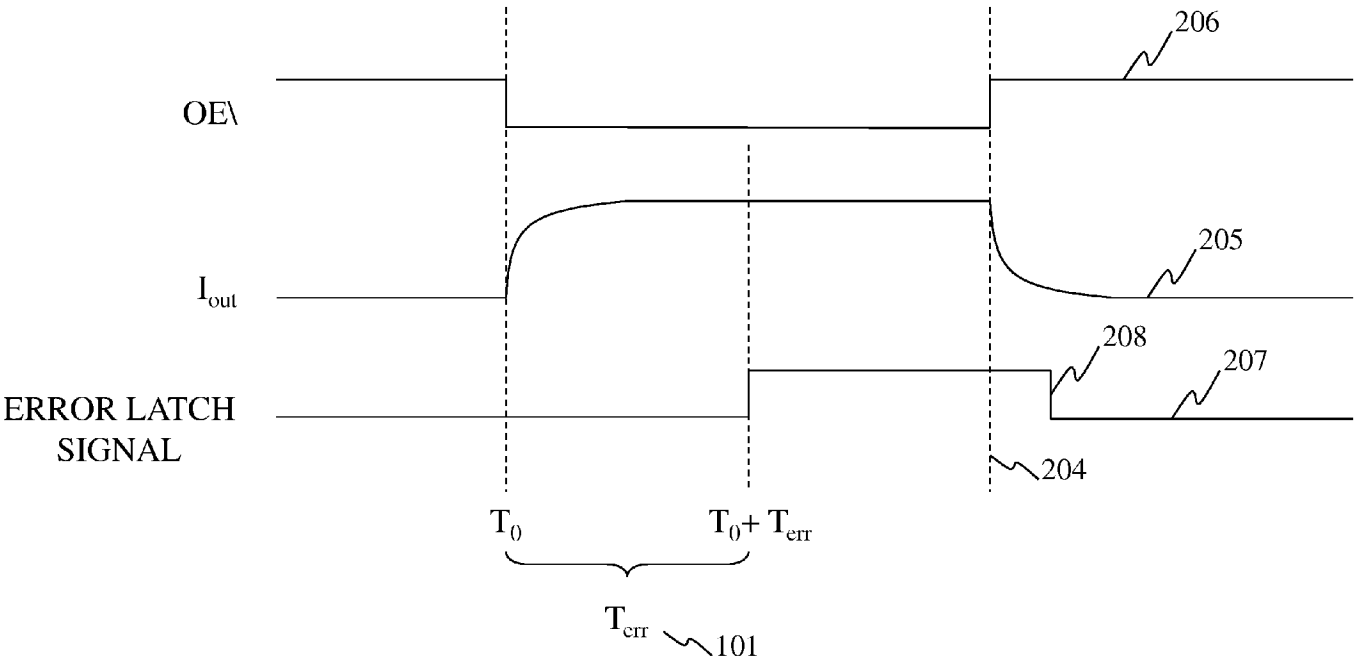
FIG. 2 is a schematic drawing illustrating the timing of signals in the error detection mode in accordance with another embodiment of the present invention.

As can be seen in FIG. 2, the OE\ signal 206 may switch to an active low level at time $t_0$, and may cause the light emitting element 350 to be driven to an ON state and the current signal $I_{out}$ 205 driving the light emitting element 350 to start rising. Similarly to the timing of FIG. 1, after the time period $T_{err}$ 101, the signal error latch 207 may switch to a high level to indicate that a test process has been completed and/or the error detection result is available. However, in the timing diagram of FIG. 2, setting the latch signal high does not trigger the driving of the light emitting component to an OFF state. Instead, the OE\ signal 206 is to control switching off the light emitting element in this embodiment of the present invention. Thus, the OE\ signal 206 may be at an active low level at time instant $t_0+T_{err}$ when completion of the test process may be indicated by switching of the signal error latch 207. Accordingly, the light emitting element 350 may be turned OFF when the OE\ signal 206 switches to an inactive high level at the time instant 204. Similarly to the timing diagram of FIG. 1, the turning OFF of the light emitting element 350 may automatically trigger the switching of the error latch signal 207 which may return to an inactive low level at time instant 208. This timing characteristic provides several advantages in situations in which the light emitting element 350 is desired to remain turned ON even after a test process has been completed. For instance, it may be useful in a display device since the test process may require a very short time which is not enough for a user to notice if the light emitting element 350 is turned ON and working. Accordingly, for instance it may be desirable to keep the light emitting element 350 turned ON for a longer time such that the user may notice if the light emitting element 350 is working or not.

Both the timing characteristic illustrated in FIG. 1 and in FIG. 2 offer the advantage that the test process duration may be reduced for each combination of parametric conditions. On the contrary, in the state of the art, a time period $T_{err}$ 101 should pass, corresponding the longest possible time for testing at any given combination of parametric conditions. Both the timing diagram illustrated by FIG. 1 and the one illustrated by FIG. 2 can be obtained by using a driver, an example of which is illustrated in FIG. 3.

Figure 3:
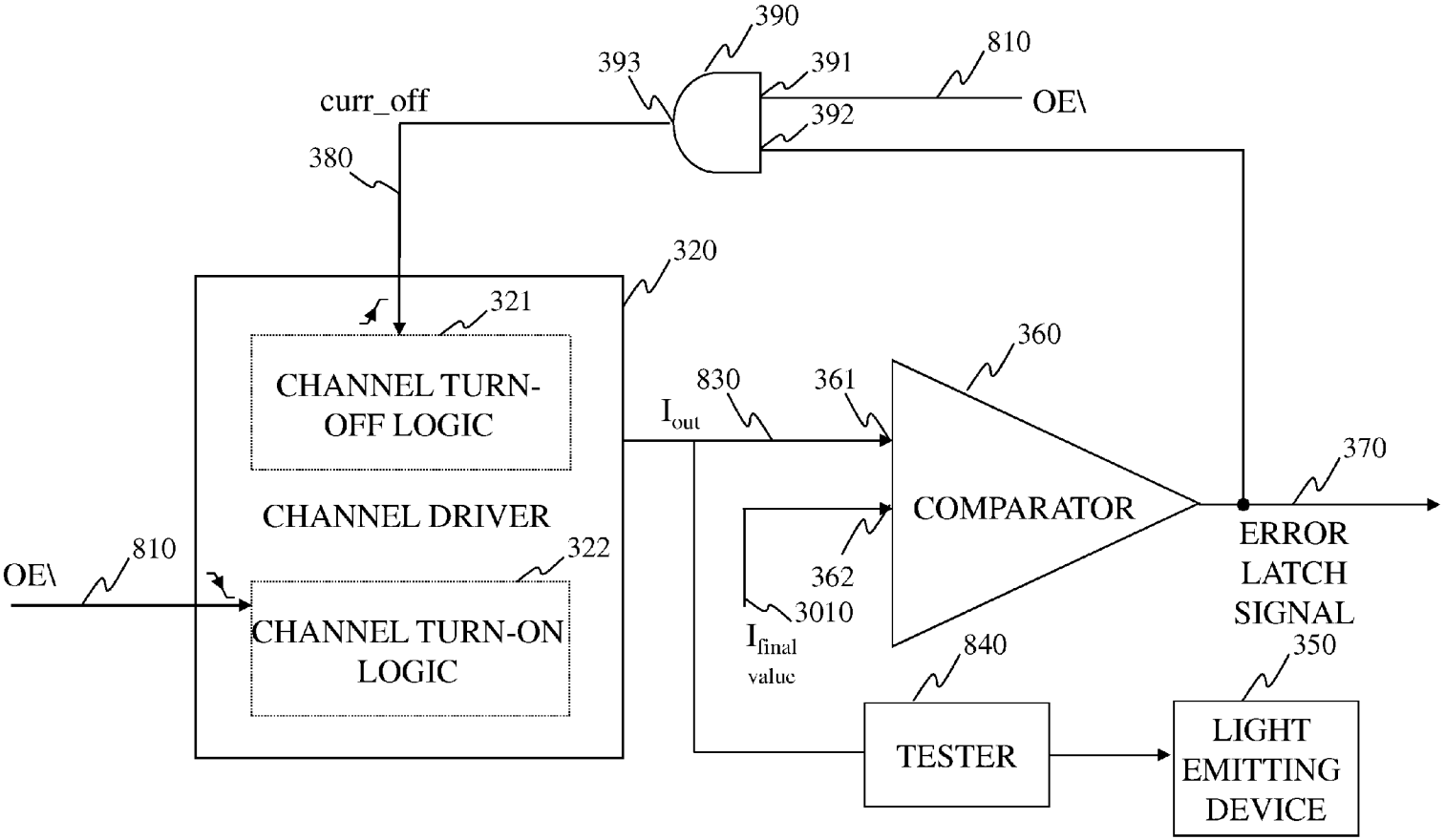
FIG. 3 is a detailed block diagram illustrating functional blocks of a driving circuit for performing error detection in accordance with an embodiment of the present invention.

As can be seen in FIG. 3, a light emitting element 350, for instance, an LED 350 may be driven by a channel driver 320 by means of a driving signal $I_{out}$ 830. The driving signal $I_{out}$ 830 may be further inputted into a comparator 360. The result of the comparison of the driving signal 830 with a second signal $I_{final\ value}$ 3010, may provide an output error latch signal 370 which may further be inputted into channel driver 320. Accordingly, the driver apparatus illustrated in FIG. 3, may work based on the input signal such as the OE\ signal 810 similarly to the state of the art. Since no additional input signal is required for implementing embodiments of the present invention, this simplifies the usage of the driver of embodiments of the present invention for the user. Furthermore, the incorporation of the driver of embodiments of the present invention within pre-existing applications may be facilitated since no additional input control signals are requested. Moreover, as can be seen in FIG. 3, the channel driver 320 may include a channel turn-off logic 321 and a channel turn-on logic 322. The channel turn-on logic 322 may be connected to the OE\ signal 810. The channel turn-off logic 321 may be connected to a curr_off signal 380. Moreover, the comparator 360 may have a first input 361 and a second input 362. The first input 361 may be connected to the $I_{out}$ signal 830. The second input 362 may be connected to $I_{final\ value}$ signal 3010. The $I_{final\ value}$ 3010 may be a reference value which is determined based on the output current of the driver. For instance, the $I_{final\ value}$ 3010 may be set to 90% of the driver's output current. Such a setting may be achieved by creating a reference current, corresponding to the driver output current, by means of a voltage generator and a resistance either integrated in or connected outside the driving, by providing a portion, such as 90% of the output current to the input of the comparator 360. The value of 90% is only an example value, and in practice, values of 80%, 85%, 95% etc. may be used as well. In general, the portion of the current may be set according to a desired testing application. It is beneficial, if this portion is at least as high as or higher than the threshold for determining an error condition in order to allow reliable error detection. For instance, an open circuit at the light emitting element may be determined if the measured current is less than 50% of the output current of the driver. In order to enable a reliable testing in such a case, the threshold $I_{final\ value}$ 3010 should be at least 50% of the output current or, preferably, more than that. However, the present invention is not limited to the setting of $I_{final\ value}$ 3010 as described above. In general, the driving apparatus could also provide an input for externally setting the $I_{final\ value}$ 3010, or the value of $I_{final\ value}$ 3010 may be fixedly set assuming particular testing conditions.

The driver of FIG. 3 may further include an AND gate 90. The AND gate 390 may have a first input 391, a second input 392 and an output 393. The first intput 391 of the AND gate 390 may be connected to the OE\ signal 810. The second input 392 of the AND gate 390 may be connected to the error latch signal 370 outputted by comparator 360. Moreover, the AND gate 390 may output the curr_off signal 380 to the channel turn-off logic 321. The operation of the driver of FIG. 3 will now be described in detail.

When the OE\ signal 810 switches to an active low value, the channel turn-on logic 322 of channel driver 320 may start to drive the light emitting element 350 and the $I_{out}$ signal 830 may start to rise. Upon $I_{out}$ signal 830 reaching a certain value corresponding to the $I_{final\ value}$ 3010, the output error latch signal 370 of the comparator 360 may switch to an active high level. At this point, if the OE\ signal 810 is still at an active low value, the output curr_off 380 of the AND gate 390 will not switch and the channel driver 320 may keep on driving the light emitting component 850 to an ON state by means of channel turn-on logic 322. On the other hand, if the OE\ signal 810 is at an inactive high value, the output curr_off signal 380 of the AND gate 390 may switch to an active high level thereby instructing the channel turn-off logic 321 so as to drive the light emitting element 350 to an OFF state. When the light emitting element 350 is driven to an OFF state, signal $I_{out}$ 830 starts to decrease which may cause the output error latch signal 370 of comparator 360 to switch to an inactive low level. The tester 840 may work as in the prior art, for instance, by measuring the driving signal (output current and/or voltage) while the light element is switched on and to evaluate based on predefined conditions whether an error occurred or not. For instance, an open line may be detected if the measured output current is lower than a certain value. Embodiments of the present invention allow stopping such measurement earlier according to the particular current value reached, for instance by terminating the channel driving as described above. Alternatively, or in addition, a short condition on the light emitting element may be detected, for instance, by measuring the voltage drop on the light emitting element. If the voltage drop is lower than a certain value, a short circuit is detected. Still alternatively or in addition, a light emitting element with unexpected behavior (out of specification) may be detected similarly as a short condition, for instance by comparing the measured and expected drop of voltage at the light-emitting element. As will be obvious to those skilled in the art, other conditions may be detected by comparing the measured output voltage and current with the corresponding expected values. For instance, a short line to the ground may be detected based on the output current being lower than a threshold, the above exemplified conditions may be combined, and new conditions may be added. Performing the comparisons contributes to the time $T_{meas}$.

The example driving apparatus described with reference to FIG. 3 provides an advantage of a simple implementation. In particular, generating the latch signal based on comparison between the measured driver's output current (with light-emitting element set ON) and a predefined value $I_{final\ value}$ 3010 enables fast implementation. This implementation reduces the error detection time to the time $T_{rise}$ necessary for $I_{out}$ to reach the value $I_{final\ value}$ 3010 and the time $T_{meas}$ which includes the latency of the comparator 360. Typically, a latency of a comparator is 60 ns to 100 ns, depending on the power supply.

In general, the light emitting element driven and tested according to the present invention does not necessarily have to be an LED. It may also be, for instance, an OLED or any other light emitting element.

The driving apparatus of the present invention may also be used for driving and testing of a plurality of light emitting elements. These may be tested in parallel and the results of testing (error detection) may be output, for instance, serially. However, the present invention is not limited thereto and, in general, the testing could also be performed serially, or the output could also be performed in a parallel way. The signal measured for determining the open/short condition may be either a current or a voltage signal.

In accordance with another embodiment of the present invention, the driver of the present invention is realized by incorporating it into an integrated circuit chip. Alternatively, any of the components of the driver of embodiments of the present invention may be realized by one or more integrated circuit chips enclosed in one or more packages.

Another embodiment of the invention relates to the implementation of the above described various embodiments using hardware and software. It is recognized that the various embodiments of the invention may be implemented or performed using computing devices (processors). A computing device or processor may for example be general-purpose processors, digital signal processors (DSP), application specific integrated circuits (ASIC), field programmable gate arrays (FPGA) or other programmable logic devices, etc. The various embodiments of the invention may also be performed or embodied by a combination of these devices.

Further, the various embodiments of the invention may also be implemented by means of software modules, which are executed by a processor or directly in hardware. Also a combination of software modules and a hardware implementation may be possible. The software modules may be stored on any kind of computer readable storage media, for example RAM, EPROM, EEPROM, flash memory, registers, hard disks, CD-ROM, DVD, etc.

Summarizing, embodiments of the present invention relate to driving a light-emitting element by a driver capable of testing at least an open or short condition of the light-emitting element. In particular, a driving signal is generated to drive the light-emitting element. It is evaluated based on the value of the driving signal whether a predetermined condition is reached. If so, a latch signal is output indicating that the testing has finished.

What is claimed is:

1. A driving apparatus for driving a light emitting element, the driving apparatus comprising:

a driving means for outputting a driving signal for driving a light emitting element, a testing means for testing the light emitting element by measuring the driving signal, and an evaluating means for determining that the value of the driving signal reaches a predetermined condition, and for outputting a latch signal, indicating that testing is completed, at a time when the value of the driving signal reaches the predetermined condition.

2. The driving apparatus according to claim 1, wherein the driving means is configured to start driving the light emitting element upon change of level of an output enable signal input to the driving means.

3. The driving apparatus according to claim 2, wherein the output enable signal is a logic signal and the driving means is configured to start driving the light emitting element upon setting the output enable signal to low level.

4. The driving apparatus according to claim 2 further comprising a turn-off logic means for turning off the light emitting element upon change of the level of the output enable signal.

5. The driving apparatus of claim 4, wherein the turn-off logic includes an AND logic gate, the two inputs of the AND logic gate being the output enable signal and the latch signal, and the output of the AND logic gate is a signal controlling turning off the driving of the light emitting element.

6. The driving apparatus according to claim 1 wherein the latch signal is a logic signal.

7. The driving apparatus according to claim 1 further comprising a turn-off logic means for turning off the light emitting element when the evaluating means outputs the latch signal indicating that testing is completed.

8. The driving apparatus according to claim 1 wherein the latch signal is a pulse of a predetermined height and length.

9. The driving apparatus according to claim 1 wherein the light emitting element is at least one LED.

10. The driving apparatus according to claim 1 wherein the evaluating means includes a comparator configured to compare the driving signal with a predetermined value and to determine that the predetermined condition is reached if the value of the driving signal is equal to and/or greater than the predetermined value.

11. The driving apparatus according to claim 1 wherein the testing means is configured, based on a measurement of current or voltage of the driving signal, to detect an open or a short circuit.

12. An integrated circuit implementing the driving apparatus according to claim 1.

13. A driving method for driving a light emitting element, the driving method comprising:

driving, with a driving means, a light emitting element by outputting a driving signal, testing, with a testing means, the light emitting element by measuring the driving signal, determining, with an evaluating means, that the value of the driving signal reaches a predetermined condition, and outputting, with the evaluating means, a latch signal, indicating that testing is completed, at a time when the value of the driving signal reaches the predetermined condition.

14. The driving method according to claim 13, wherein driving of the light emitting element is initiated upon change of level of an output enable signal input to the driving means.

15. The driving method according to claim 14, wherein the output enable signal is a logic signal and driving is initiated upon setting the output enable signal to low level.

16. The driving method according to claim 13 further comprising a driving to an OFF state the light emitting element upon outputting the latch signal indicating that testing is completed.

17. The driving method according to claim 13 further comprising driving to an OFF state the light emitting element upon change of the level of the output enable signal.

18. The driving method according to claim 13 wherein the latch signal is a logic signal.

19. The driving method according to claim 18 wherein the latch signal is a pulse of a predetermined height and length.

20. The driving method according to claim 13 wherein the light emitting element is at least one LED.

21. The driving method according to claim 13 wherein determining includes comparing the driving signal with a predetermined value and determining that the predetermined condition is reached if the value of the driving signal is equal to and/or greater than the predetermined value.

22. The driving method according to claim 13 wherein testing includes, based on a measurement of current or voltage of the driving signal, detecting an open or a short circuit.

23. A computer program product comprising a computer readable medium having a computer readable program code embodied thereon, the program code being adapted to carry out the method according to claim 13.

24. A driver for a light-emitting element, comprising:

a driver circuit configured to output a driving signal for driving a light-emitting element;

a test circuit configured to test the light-emitting element by measuring the driving signal; and an evaluation circuit configured to determine that a value of the driving signal meets a predetermined condition, and to provide a latch signal at a time when the value of the driving signal meets the predetermined condition.

25. A driver for a light-emitting element as defined in claim 24, wherein the evaluation circuit comprises a comparator configured to compare the driving signal with a reference value and to provide the latch signal in response to the driving signal exceeding the reference value.

26. A driver for a light-emitting element as defined in claim 24, wherein the driver circuit includes turn-off logic configured to turn off the light-emitting element when the evaluation circuit provides the latch signal.

27. A driver for a light-emitting element as defined in claim 24, wherein an active state of the latch signal indicates that testing is completed.

28. A driver for a light-emitting element as defined in claim 24, wherein the driving signal is turned on by the driver circuit in response to a transition of an output enable signal to an active state and is turned off in response to a transition of the latch signal to an active state.

29. A driver for a light-emitting element as defined in claim 24, wherein the driving signal is turned on by the driver circuit in response to a transition of an output enable signal to an active state and is turned off in response to a transition of the output enable signal to an inactive state.

30. A driver for driving a light-emitting element as defined in claim 24, wherein the test circuit is configured to detect an open or a short circuit condition of the light-emitting element.

31. A method for driving a light-emitting element, comprising:

supplying, by a driver circuit, a driving signal for driving a light-emitting element;

testing, by a test circuit, the light-emitting element by measuring the driving signal; and determining, by an evaluation circuit, that a value of the driving signal meets a predetermined condition and providing a latch signal at a time when the value of the driving signal meets the predetermined condition.

32. A method for driving a light-emitting element as defined in claim 31, wherein determining and providing comprise comparing the driving signal with a reference value and providing the latch signal in response to the driving signal exceeding the reference value.

33. A method for driving a light-emitting element as defined in claim 31, wherein supplying the driving signal includes turning off the light-emitting element in response to providing the latch signal.

34. A method for driving a light-emitting element as defined in claim 31, wherein supplying the driving signal comprises turning on the driving signal in response to a transition of an output enable signal to an active state and turning off the driving signal in response to a transition of the latch signal to an active state.

35. A method for driving a light-emitting element as defined in claim 31, wherein supplying the driving signal comprises turning on the driving signal in response to a transition of an output enable signal to an active state and turning off the driving signal in response to a transition of the output enable signal to an inactive state.

* * * * *

UNITED STATES PATENT AND TRADEMARK OFFICE

CERTIFICATE OF CORRECTION

PATENT NO. : 8,786,195 B2
APPLICATION NO. : 13/047299
DATED : July 22, 2014
INVENTOR(S) : Castiglia et al.

It is certified that error appears in the above-identified patent and that said Letters Patent is hereby corrected as shown below:

On the title page, item [30], delete "VI2010A0081" and insert --VI2010A000081--.

In the Specification:

Column 7, Line 45, "90" should read --390--;
Column 8, Line 39, "60 ns to 100 ns" should read --60ns to 100ns--.

In the Claim:

Column 10, Line 23, Claim 16, the word "a" should be deleted.

Signed and Sealed this
Seventh Day of October, 2014

Michelle K. Lee

Michelle K. Lee
*Deputy Director of the United States Patent and Trademark Office*